US008616992B2

(12) United States Patent
Kim

(10) Patent No.: US 8,616,992 B2
(45) Date of Patent: Dec. 31, 2013

(54) PUTTER WITH ALIGNMENT INDICIA

(76) Inventor: Dae Wook Kim, Tuenmun (HK)

( * ) Notice: Subject to any disclaimer, the term of this patent is extended or adjusted under 35 U.S.C. 154(b) by 410 days.

(21) Appl. No.: 12/601,583

(22) PCT Filed: May 27, 2008

(86) PCT No.: PCT/CN2008/001025

§ 371 (c)(1),
(2), (4) Date: Nov. 24, 2009

(87) PCT Pub. No.: WO2008/148294

PCT Pub. Date: Dec. 11, 2008

(65) Prior Publication Data

US 2010/0173720 A1 Jul. 8, 2010

(30) Foreign Application Priority Data

Jun. 1, 2007 (CN) ..... 2007 1 0109636

(51) Int. Cl.
*A63B 69/36* (2006.01)

(52) U.S. Cl.
USPC ..... 473/252; 473/253; 473/254; 473/255

(58) Field of Classification Search
USPC ..... 473/219–256, 340–341; D21/736–746
See application file for complete search history.

(56) References Cited

U.S. PATENT DOCUMENTS

| | | | | | |
|---|---|---|---|---|---|
| 3,880,430 | A * | 4/1975 | McCabe | ..... | 473/253 |
| 4,136,877 | A * | 1/1979 | Antonious | ..... | 473/254 |
| 4,458,900 | A * | 7/1984 | Antonious | ..... | 473/254 |
| 4,962,931 | A * | 10/1990 | Jazdzyk, Jr. | ..... | 473/252 |
| 4,986,544 | A * | 1/1991 | Benson | ..... | 473/254 |
| 5,275,412 | A * | 1/1994 | Innes | ..... | 473/253 |
| 5,538,249 | A * | 7/1996 | Benson | ..... | 473/254 |
| 5,921,868 | A * | 7/1999 | DiMartino | ..... | 473/254 |
| 6,062,986 | A * | 5/2000 | Kaise | ..... | 473/242 |
| 7,052,409 | B2 * | 5/2006 | Goldsmith | ..... | 473/242 |
| 7,341,526 | B2 * | 3/2008 | McCarthy | ..... | 473/251 |
| 7,611,419 | B2 * | 11/2009 | O'Neill | ..... | 473/242 |
| 7,766,762 | B2 * | 8/2010 | Stellander | ..... | 473/251 |
| 7,789,764 | B2 * | 9/2010 | Wilson et al. | ..... | 473/220 |
| 7,815,515 | B1 * | 10/2010 | Hunt | ..... | 473/251 |
| 2008/0009361 | A1 * | 1/2008 | Johnson | ..... | 473/251 |

* cited by examiner

*Primary Examiner* — Sebastiano Passaniti
(74) *Attorney, Agent, or Firm* — Bishop Diehl & Lee, Ltd.

(57) ABSTRACT

A putter includes a handle (2), a putter head (1) with a striking surface, and two alignment indicia (6) symmetrically arranged relative to a vertical plane (20) which is perpendicular to the striking surface and passes through a striking line. Wherein the visible part of the alignment indicia (6) are symmetrical to the vertical plane (20) when being viewed in the vertical plane (20), while not symmetrical to the vertical plane (20) when being viewed in a plane offsetting from the vertical plane (20).

11 Claims, 13 Drawing Sheets

PUTTER WITH ALIGNMENT INDICIA

1. FIELD OF INVENTION

This invention is related to the putter of golf equipment.

2. BACKGROUND OF INVENTION

In order to have a good performance in putting the ball to hole, the player's eyes 33 are to be aligned exactly on the top of the putting line so that the player can see the ball and centre alignment mark 4 (or line) on putter (match with putting line 31) and target hole 32 to be all in one line. Otherwise the ball putted goes to the wrong direction not intended by player due to misalignment. However we can not find any suitable putter to fulfill these performances in the market.

Usually golf coaches ask golf beginners to make another ball drop from the eyes to hit the aligned ball to be put in order to find whether the player has a good alignment.

3. SUMMARY OF INVENTION

The purpose of the invention is to provide easier putting stance for the player to make the player's eyes to be put on the right top of the ball and putting line exactly.

The invention provides a putter having two different heights of alignment marks on putter head, one is upper alignment marks (blocking face 5) and the other Is lower alignment marks 6 which have two different colors or can be distinguished each other easily by eyes, either by painting or by steps or other materials, so when the player finished putting stance, player can recognize the lower alignment marks 6 through the upper alignment marks so as to determine the alignment is correct or not, as can been best seen from Figs.

Once the player has a stance with good alignment, player's eyes are at the right top of the centre of putting line 31, the player can see the alignment marks at toe side (T) and at heel side (H) of the putter head having equal widths (H=T).

However the player has a stance with wrong alignment, player's eyes are not at the top, of the centre of putting line, the player can see the lower aligned mark to toe side and to heel side having different widths (H>T or H<T) due to the shadows covered by a blocking face 5 (the upper alignment marks).

In order to achieve the above purpose and the others, the invention provides a putter having a shaft and a putter head, the putter head having a putting face, characterized in that further comprising two alignment marks which arranged symmetric with respect to a vertical plane which is perpendicular to the putting face and a putting line is within the vertical plane, a putting line is within the vertical plane, wherein the alignment marks are configured in such a way that when looking down from the vertical plane visible portions of the alignment marks are symmetric with respect to the vertical plane and when looking down with a deflection from the vertical plane the visible portions of the alignment marks are not symmetric with respect to the vertical plane.

In one embodiment, the alignment marks are in a same horizontal plane, a blocking face being narrower than the alignment marks is arranged in a plane parallel to and higher than the plane of the alignment marks.

The blocking face can be a top surface of a block extending upward from the plane of the alignment marks.

In one embodiment, steps are arranged between the block and the plane of the alignment marks.

Wherein the block can be in a trapezohedron form with its bottom face being larger than its upper face, alignment marks being arranged on both side surface of the block.

In another embodiment, the alignment marks are respectively arranged in two planes which are symmetric to the vertical plane and extend upwardly.

The invention also provide a putter having a shaft and a putter head, the putter head having a putting face, wherein a substantially horizontal face is formed in the putter head, a block is formed above the face and parallel thereto and being symmetric with respect to a vertical plane being perpendicular to the putting face and passing a putting line, the block has a groove extending therethrough, the groove being symmetric with respect to the vertical plane, an alignment mark is arranged on vertical projection of the groove on the face and having a width substantially equal to the width of the groove, the alignment mark being symmetric with respect to the vertical plane, addition marks are arranged beside each side of the alignment mark respectively. wherein the addition marks are different from the alignment mark.

The invention also provided a manufacturing method for a putter, wherein the putter having a shaft and a putter head, the putter head having a putting face, the manufacturing method comprising arranged two alignment marks symmetric to a vertical plane which is perpendicular to the putting face, a putting line is within the vertical plane, wherein the alignment marks are configured in such a way that when looking down from the vertical plane visible portions of the alignment marks are symmetric and when looking down with a deflection from the vertical plane the visible portions of the alignment marks are not symmetric.

The invention also provides a manufacturing method for a putter, wherein the putter having a shaft and a putter head, the putter head having a putting face, wherein arranging a substantially horizontal face 8 on the putter head, forming a block above the face and parallel thereto and being symmetric with respect to a vertical plane, the vertical plane being perpendicular to the putting face and passing a putting line, forming a groove in the block and extending therethrough, the groove being symmetric with respect to the vertical plane, arranging an alignment mark on vertical projection of the groove on the face, wherein the alignment mark having a width substantially equal to the width of the groove and being symmetric with respect to the vertical plane, arranging addition marks beside each side of the alignment mark respectively. wherein the addition marks are different from the alignment mark.

4. BRIEFLY DESCRIPTION OF THE FIGURES

5. DESCRIPTION OF INVENTION

Figure 1:
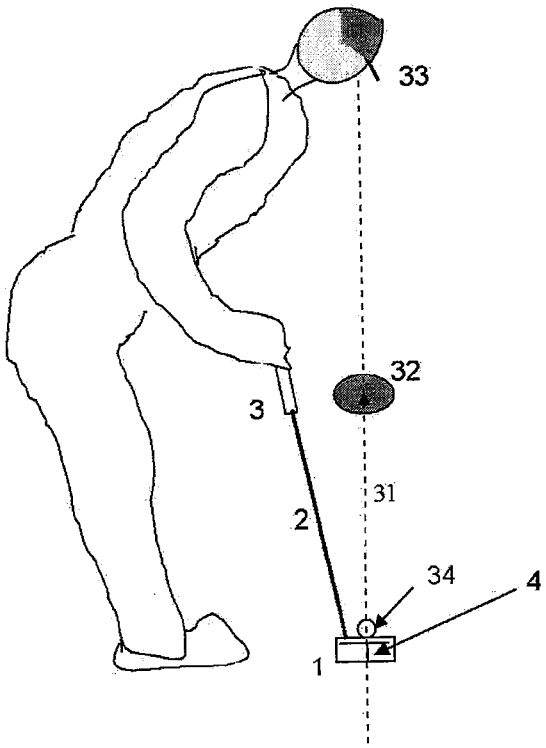
FIG. 1 is a general structure of putting alignment.

As shown on FIG. 1, usually putter is composed with putter head 1 and shaft 2 and shaft grip 3. In the drawings, it is showing the putting alignment between the hole and ball and the centre alignment mark 4 and putting line and player's eyes must be in line at the top of the centre of the putting line.

Figure 2:
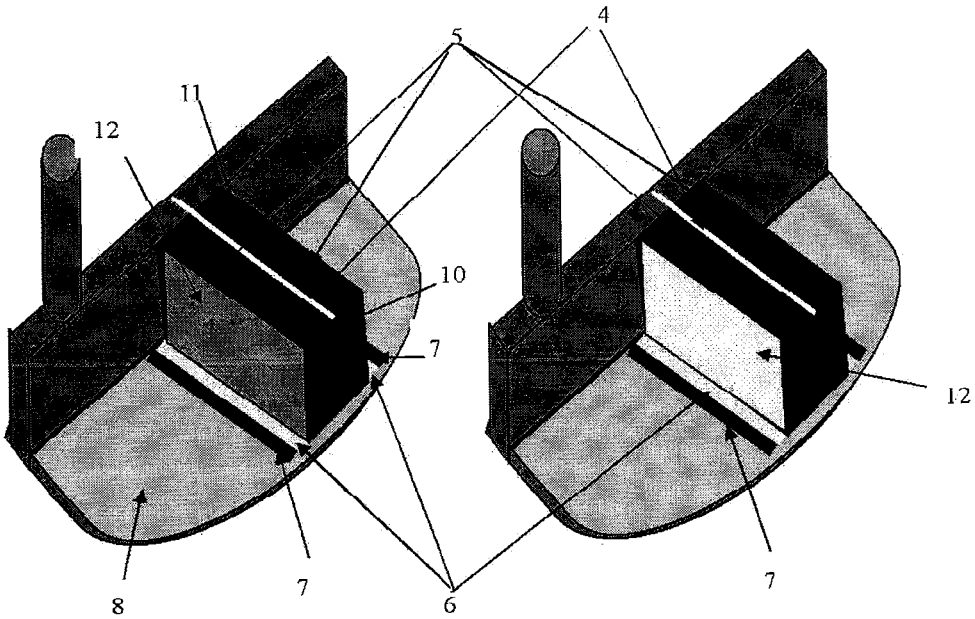
FIG. 2 is a typical type of putter head according to the invention.

Normally the putter head has a front-end surface (putting face) for hitting the ball, a rear-end surface, and two side surfaces called toe and heel. Usually the conventional putter head has a centre alignment mark 4 on the top of the putter head for making alignment with putting line FIG. 2 is showing an embodiment of the putter according to the invention. There is a centre alignment mark 4 on the top surface 11 of the putter head 1. It should be understood that the centre alignment mark 4 is in line with the putting line (theoretical) when in proper alignment. In a simplified situation, i.e. the top surface 11 is perpendicular to the putting face, the centre alignment mark 4 is perpendicular to the putting face. There is a block 10 arranged at the rear portion of the putter head. The block 10 is symmetric with respect to a vertical plane 20 (FIG. 6) passing the centre alignment line 4. Namely, the putting line is within the vertical plane. As shown in the figures, the block is flush with the putting face. However, it would be acceptable if the block is not flush with the putting face. The top surface 11 of the block 10 is formed as a blocking face 5. The block extends downwardly and connects with the putter head at a face 8. In other words, the block is extending upwardly from the face 8 and being flush with the putting face. Two alignment marks 6 are symmetrically arranged beside the block on the face 8. As a consequence. the alignment marks 6 are symmetric with respect to the vertical plane. Addition marks 7 are arranged beside the alignment marks so that the alignment marks can be easier distinguished when viewing from the above. The side surfaces 12 of the block can have marks thereon. The blocking face 5 has different marks with the alignment marks 6.

Figure 3:
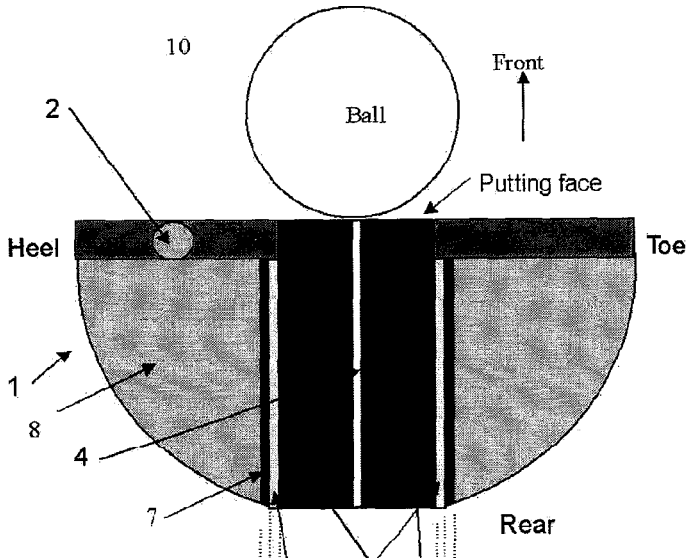
FIG. 3 is a top view of putter head according to the invention

FIG. 3 is showing a top view of a putter head according to the invention. It shows the descriptions of the blocking face 5 and the alignment marks 6 and the centre alignment mark 4.

Figure 4A:
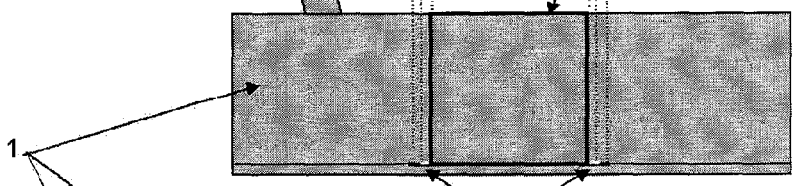
FIG. 4 is a rear view of putter head according to the invention.
Figure 4B:
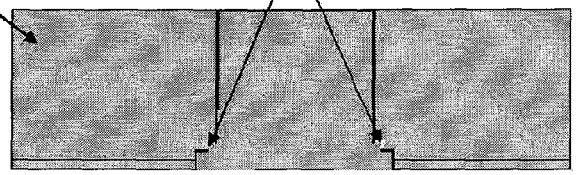
Figure 4C:
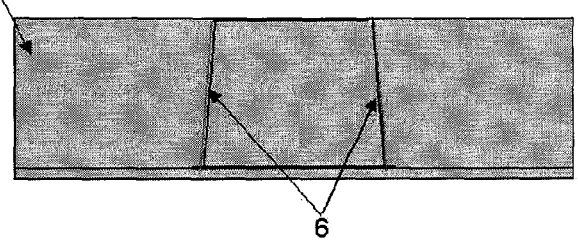

FIGS. 4*a*-4*c* are showing a rear view of the putter head of the invention. The drawings are showing various shapes of putter head style. It is also important to have two different heights between the blocking face 5 and the alignment marks 6 such that the blocking face 5 will block a certain portion of the alignment marks 6 when looking from the above. Of course, the blocking face should be narrower than the distance between the out edges of the alignment marks 6 such that the alignment marks 6 wil not be fully blocked by the blocking face 5. FIG. 4*a* is showing the embodiment of FIG. 2. In alternative, as seen in FIG. 4*b*, steps 13 may be formed between the face 8 and the block. Each surface of the steps is having different marks. It would be appreciate that the steps are also symmetrically arranged with respect to the vertical plane. FIG. 4*c* is showing that the block 10 is in a form of trapezohedron. FIGS. 4*a*-4*c* show that the block 10 is flush with the putting face. However, it should be understood that the height of the block 10 may be larger than which of the putting face.

Figure 5:
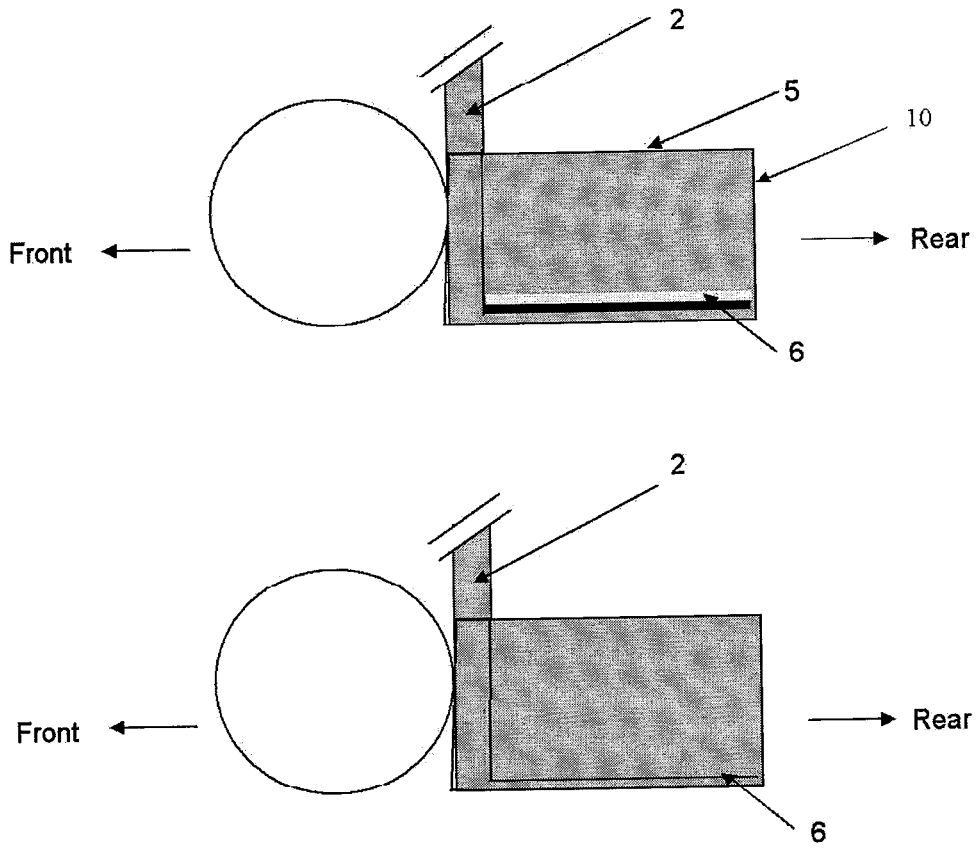
FIG. 5 is a heel side view of putter head according to the invention.

FIG. 5 is a heel view of the putter head according to the invention. The upper drawing shows there is a step while the lower drawing does not have a step.

Figure 6:
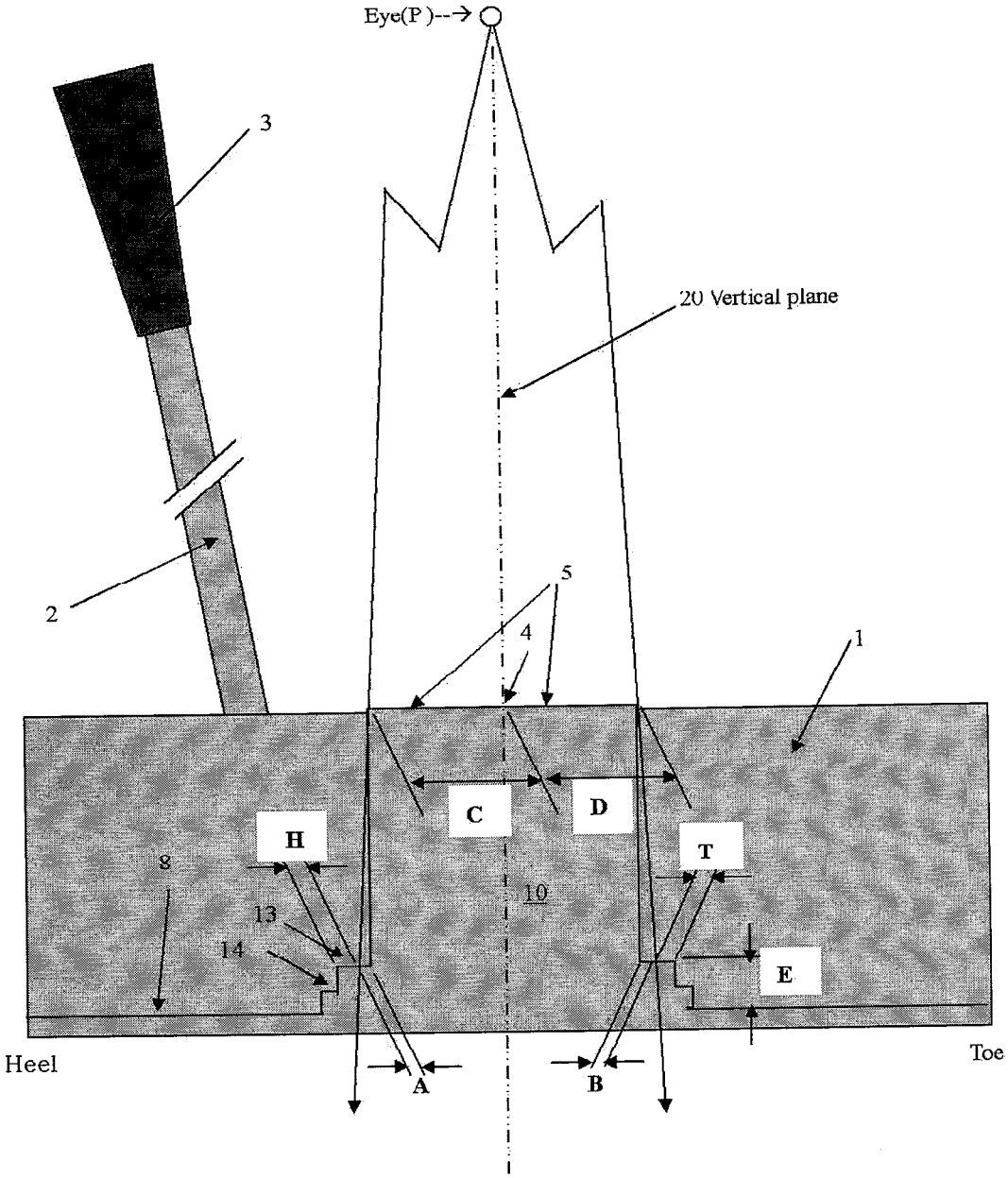
FIG. 6 is a detail description according to the invention.

Referring to FIG. 6, it is showing a principle of the invention. It has described each portion of the blocking face 5 and alignment marks 6 by viewing from the rear view. As you can see, the blocking face 5 is symmetric with respect to the vertical plane 20. Therefore, the distances C and D should be equal i.e. C=D, wherein C and D are distances between the left or right edge and the vertical plane, respectively. Or, C and D may be counted from the left or right edge of the blocking face 5 to the centre alignment marks. It is in a correct alignment in this embodiment. Eyes are in line with the putting line and the centre alignment marks 4. In the following, we are going to describe one side of the vertical plane 20 due to the symmetry. In this embodiment two steps 13, 14 are formed between the block 10 and the face 8. The alignment mark 6 is formed on the step 13 while the addition mark 7 is formed on the step 14. Due to the height difference between the blocking face 5 and step 13, One certain portion of the step 13 is blocked by the blocking face 5 as viewing from the above, i.e. point P. The width of the blocked portion can be represented by A (B as on the other side) the remaining portion of the step 13 has a width H (T as on the other side), which should be seen. Obviously A+H is equal to B+T since the steps 13 are symmetrically arranged. The width H should be equal to the width T when in good alignment, i.e. the eyes are in line with the putting line and the centre alignment marks. The height of the step can be varied as appropriate.

Figure 7A:
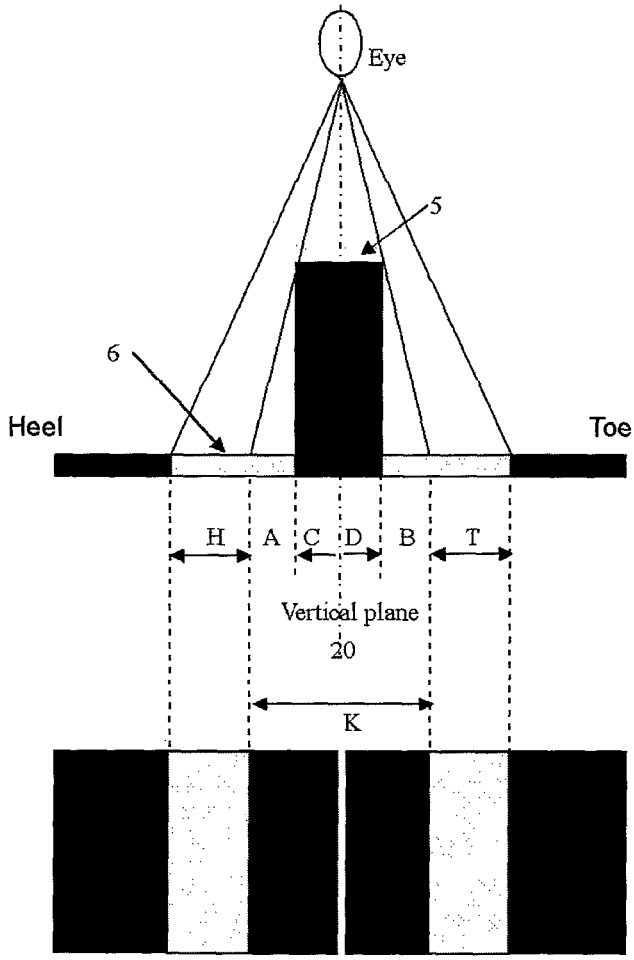
FIG. 7 is showing a basic principle of invention.
Figure 7B:
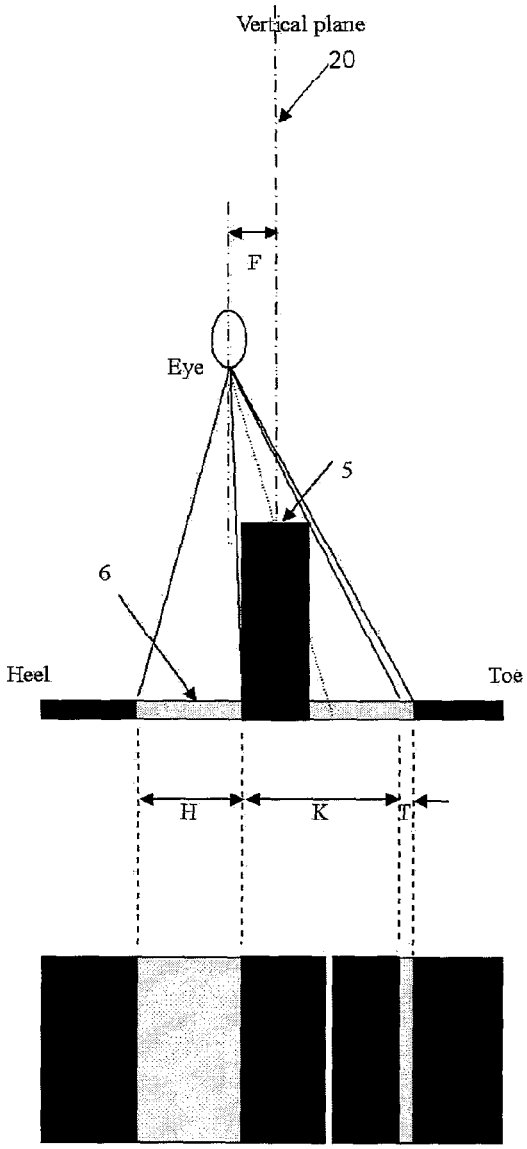
Figure 7C:
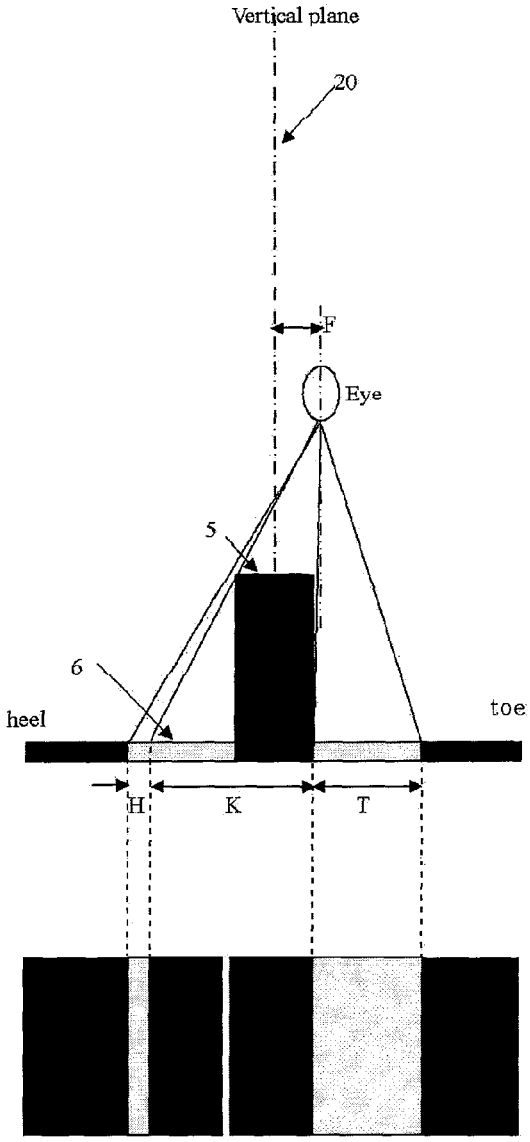

FIG. 7*a*-7*c* are schematically describe the basic principle of the invention of how to apply the invention to the actual playing and how to judge whether the player's eyes are on the top of the centre alignment marks 4 or the centre of the putting line. The shaft and the some portions of the putter head have been omitted for easier understanding.

FIG. 7*a* is showing a good alignment showing that the alignment marks at the heel side width H being seen is equal to the toe side width T being seen. In addition, it should be obvious that the width A is equal to the width B, and C is equal to D.

FIG. 7*b* & FIG. 7*c* are showing player's alignment is wrong when the player's eyes are not in line with the centre alignment line 4 and the putting line. The eyes are offset to the left side (heel side) from the vertical plane in FIG. 7*b*. Therefore the width H is larger that the width T. To an extreme, the width T can be zero if the blocking face has fully blocked the alignment mark on the right (toe side). In FIG. 7*c* the eyes are offset to the right side (toe side) from the vertical plane. In this situation, the width H is smaller than the width T. Again, to an extreme, the width H can be zero if the blocking face has fully blocked the alignment mark on the left side (heel side). In other words, the alignment mark on the left side can not be seen.

Figure 8:
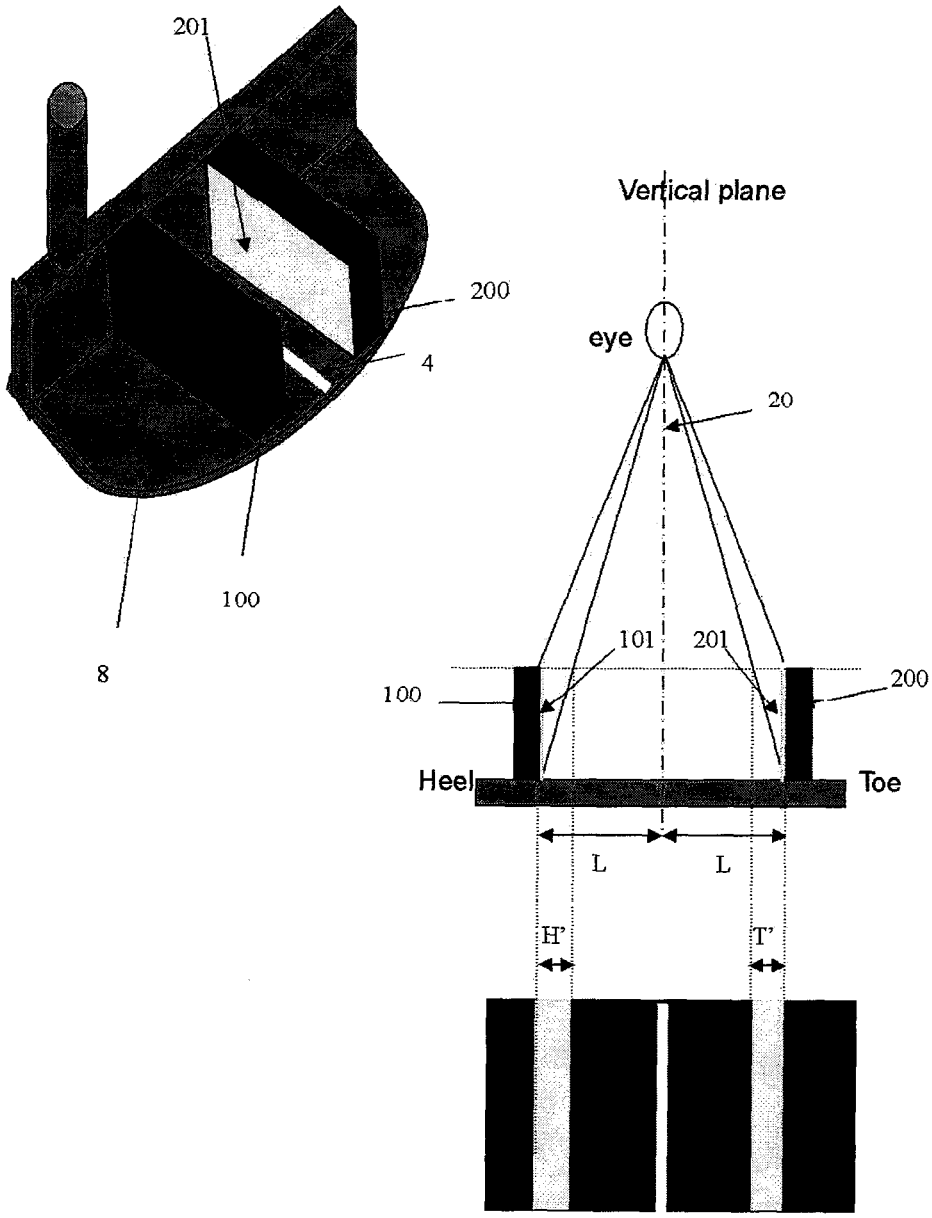
FIGS. 8-10 are showing another embodiment according to the invention.
Figure 9:
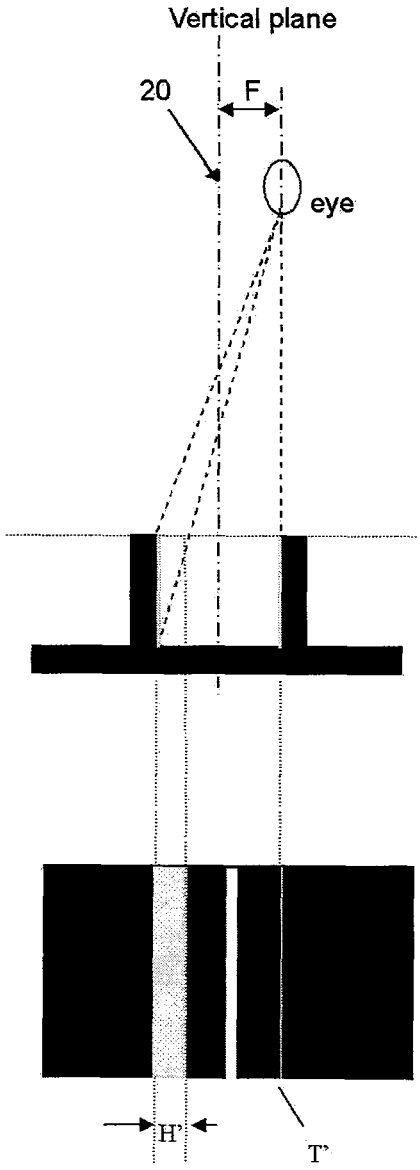
Figure 10:
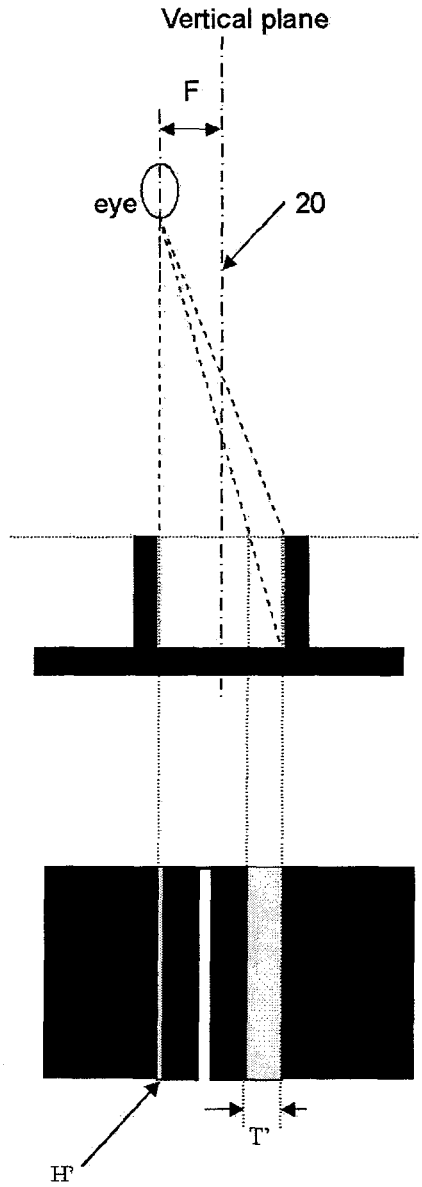

FIG. 8, FIG. 9, FIG. 10 are showing another embodiment of the invention, wherein the putter head applying the same concept of invention and same concept of judgement.

In this embodiment, two blocks 100, 200 are formed with an equal distance L from the vertical plane 20. The inner surfaces of the blocks both have alignment marks 101, 201 thereon. The blocks have a certain height such that the alignment marks also have a certain height. For example, the blocks can be flush with the putting face. In one embodiment, the inner surfaces are parallel to the vertical plane 20. However, it would be acceptable if an angle is formed between the inner surfaces and the vertical plane with the upper portions of the inner surfaces incline outwardly from the vertical plane 20.

FIG. 8 is showing a good alignment. The eyes are in line with the putting line, i.e. within the vertical plane. In this case, the width of the alignment marks 101, 201 as seen should be H' and T' respectively, wherein H'=T'. The alignment marks 101, 201 should be distinguishable from the background, i.e. the face 8.

FIG. 9 and FIG. 10 are showing a misalignment as contrary to what is shown in FIG. 8. The eyes in these two Figs deflect from the vertical plane, i.e. the putting line. In these two cases, the width of the alignment marks as seen are different. FIG. 9 shows a extreme that the T' is equal to zero and FIG. 10 shows another extreme that H'=0.

Figure 11:
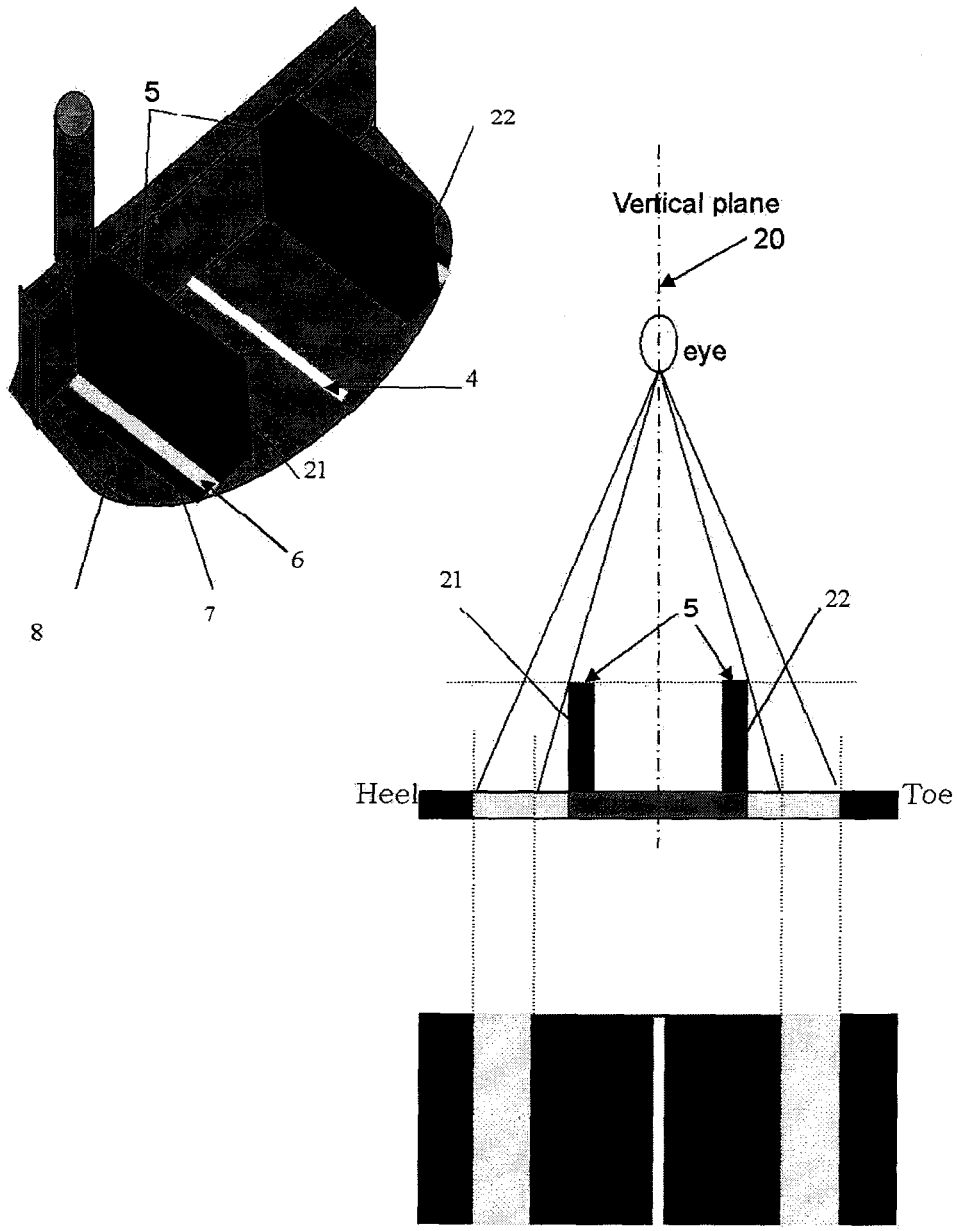
FIGS. 11-13 are showing another embodiment according to the invention.
Figure 12:
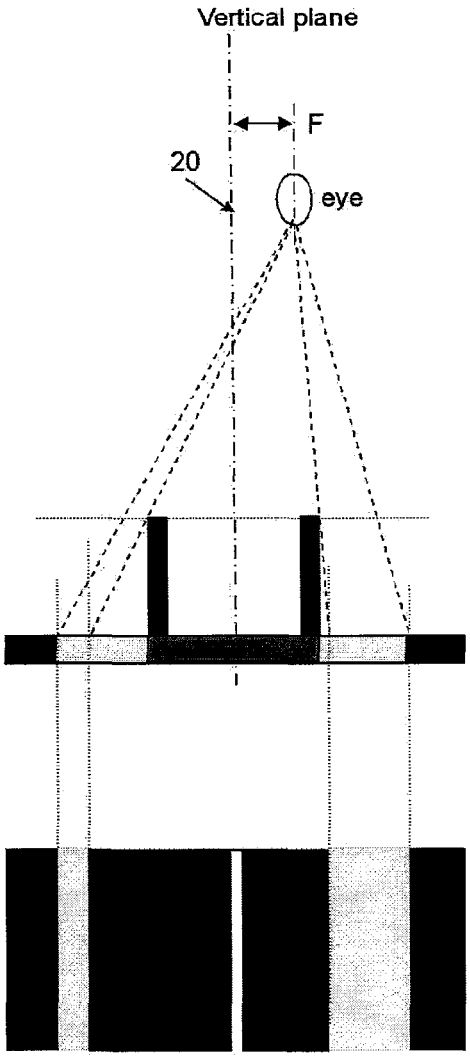
Figure 13:
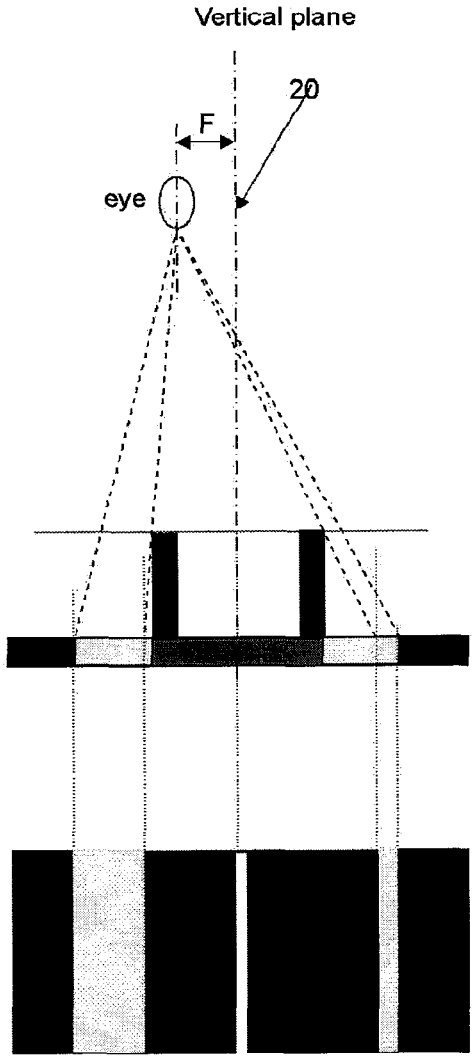

FIG. 11-13 is a modification to the embodiment of FIG. 2, wherein the block 10 is divided into two blocks 21 and 22. In this case, the centre alignment mark 4 is located on the face 8 instead of the block 10. FIG. 11 is showing a good alignment and FIGS. 12-13 are showing misalignments or wrong alignments.

Figure 14:
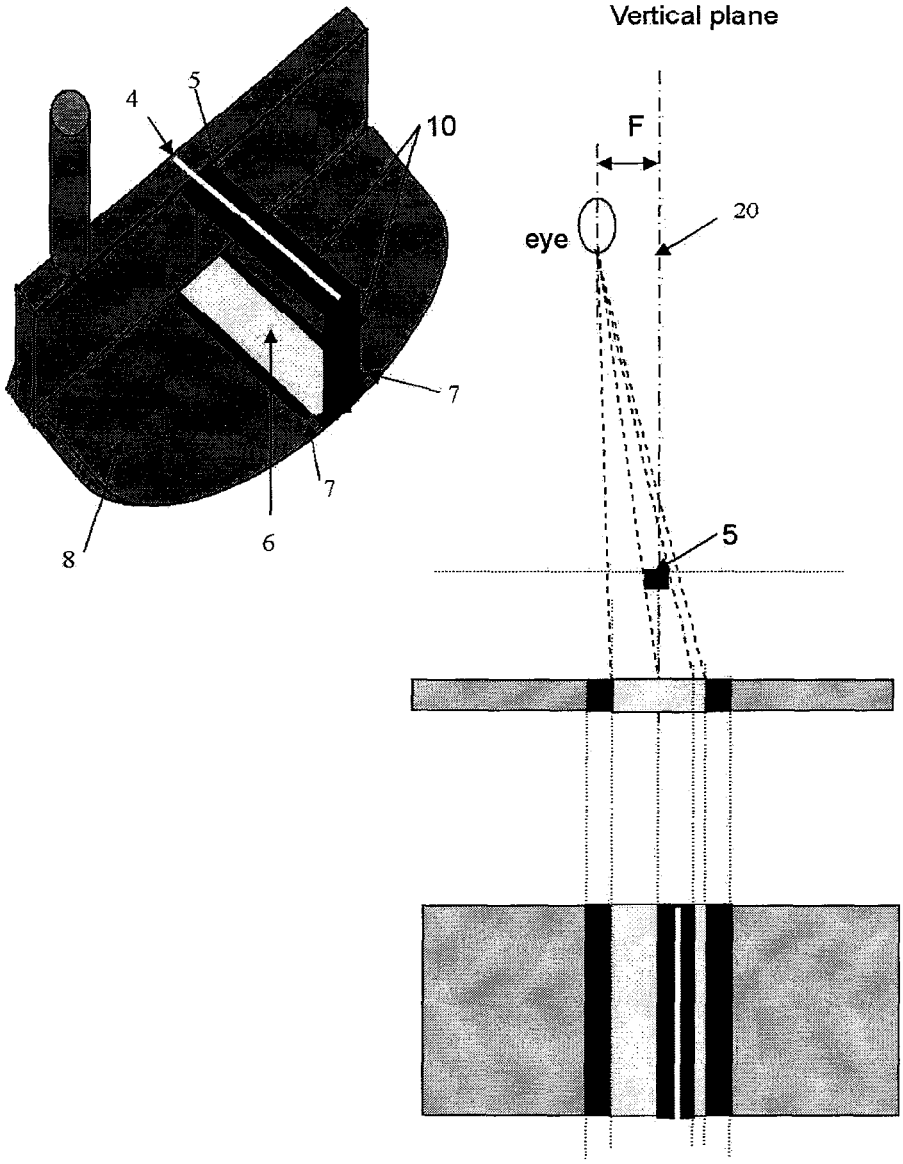
FIG. 14 is showing further another embodiment according to the invention.

FIG. 14 is also a modification to the embodiment of FIG. 2. The block 10 does not extend to contact with the face 8. Instead, the block 10 is hanging above the face 8. Similarly, the block 10 has a top surface acting as a blocking face. A centre alignment mark 4 is located on the top surface and be in line with the putting line when in good alignment. The alignment mark 6 can be formed as one piece. Addition marks 7 are arranged on both sides of the alignment mark 6. The right drawing of FIG. 14 is showing a wrong alignment.

Figure 15:
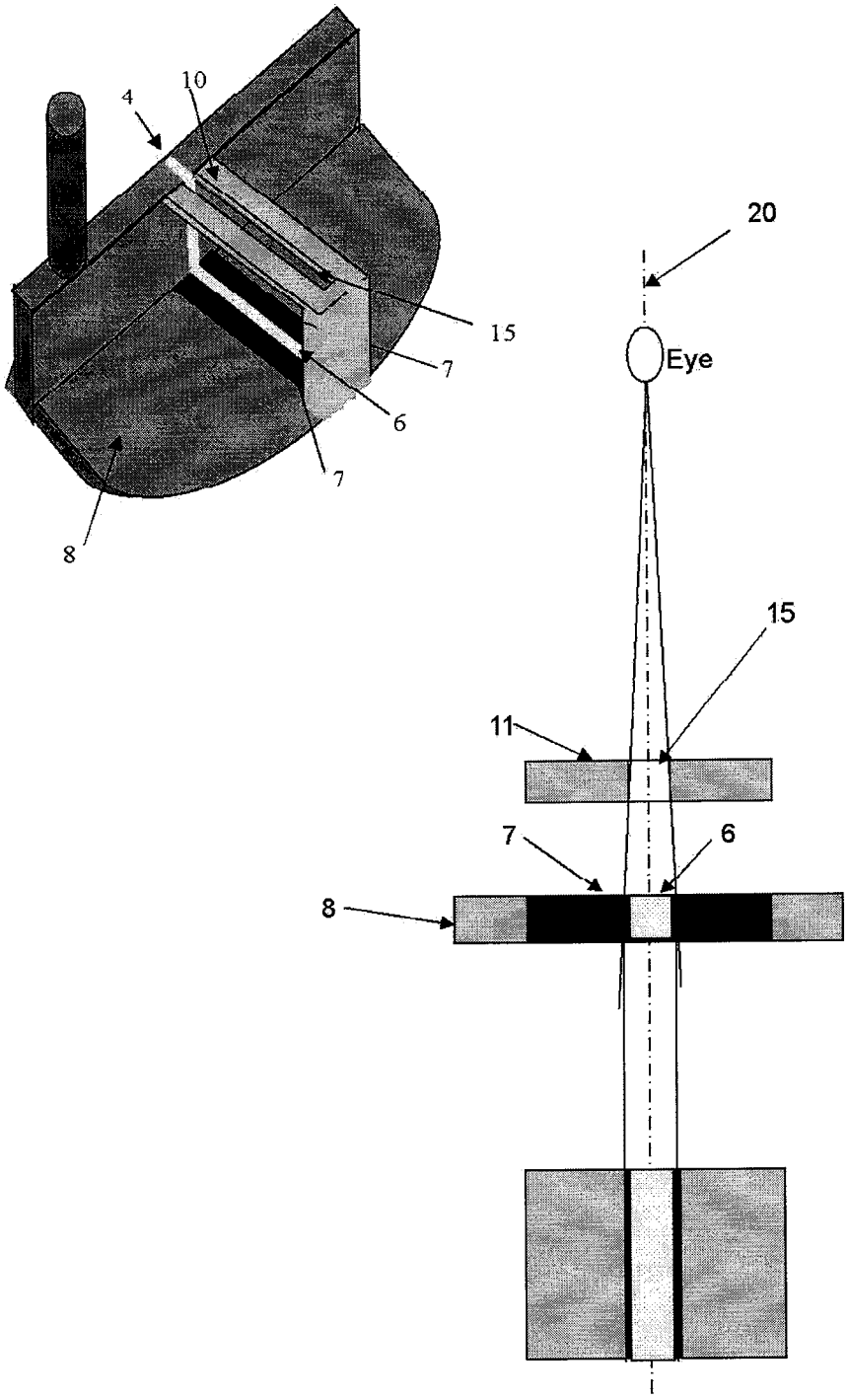
FIGS. 15-16 are showing another embodiment according to the invention.

FIG. 15 is a further embodiment of the invention. The putter head 1 has a front portion with a putting face. There is a cut-off formed in the rear portion of the putter head. The cut-off defines a face 8. As similarly mentioned above, a block 10 having a top surface as a blocking face is arranged above the face in a certain height, wherein the block is substantially parallel to the face 8 and perpendicular to a vertical plane, which is being perpendicular to the putting face and passing the putting line. There is a groove 15 formed in the block 10 and extending therethrough. The groove is symmetric with respect to the vertical plane. It would be preferable that the groove is in a direction of the putting line. An alignment mark 6 is arranged on the vertical projection of the groove on the face 8 and having a width substantially equal to the width of the groove. Hence, the alignment mark 6 is also symmetric with respect to the vertical plane. Two addition marks 7 are located on each side of the alignment marks respectively. Therefore, when viewing from the above, within the vertical plane, a user can see the alignment mark 6 and portions of the addition marks 7 symmetrically beside each side of the alignment mark 6.

A centre alignment mark 4 can be arranged on the centre of the alignment mark 6 and extending on the top surface of the putter head 1. The centre alignment mark 4 may be the same as the alignment mark 6. However, the centre alignment mark 4 can be distinguished from the alignment mark 6 so as to enhance the distinguishability.

It should be understood that the cut-off is not necessary. It is just trying to have two parallel faces in different height. For example, the face 8 could be the top surface of the putter head 1 while the block 10 is arrange above the putter head with a support plate.

Figure 16:
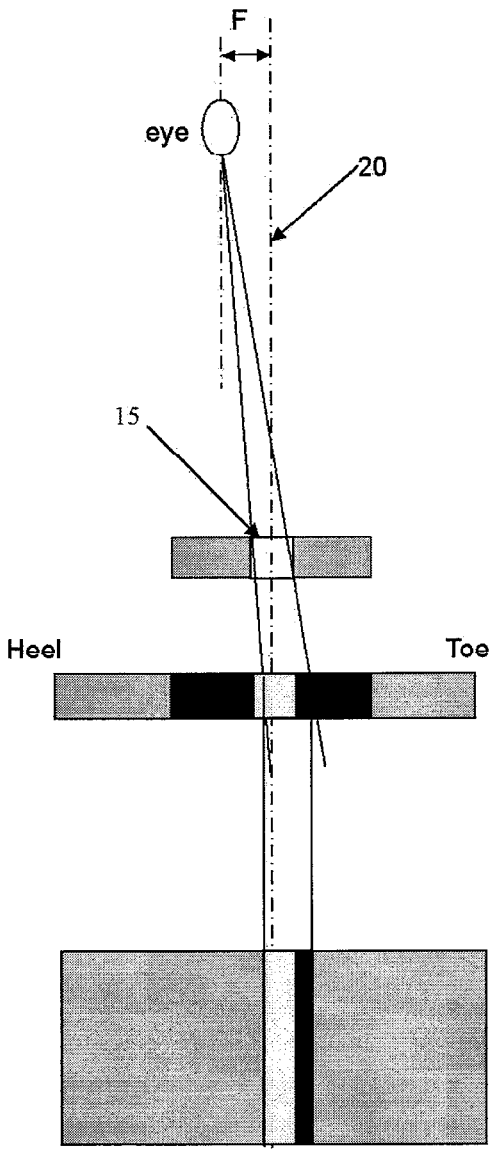

FIG. 16 is showing a wrong alignment, which is contrary to FIG. 15. When viewing fro.m the above deflecting from the vertical plane, a user cannot symmetrically see the alignment mark 6 and the addition mark 7.

The marks as mentioned above, including the alignment marks 6, the centre alignment marks 4, the addition marks 7, can be any suitable marks which can be distinguishable. Preferably, the marks are regions or areas in different color. For example, the alignment mark 6 is in yellow while the addition mark 7 is in black.

While this invention has been described in terms of several preferred embodiments, there are alterations, permutations, and equivalents which fall within the scope of this invention. It should also be noted that there are many alternatives, which shall be also within the spirit and scope of the invention.

What is claimed is:

1. A putter comprising:

a shaft; and a head attached to a distal end of the shaft, wherein the head comprises:

a toe end furthest from the shaft;

a heel end nearest to the shaft;

a generally vertical putting surface having a front face and a back face;

a generally planar alignment surface extending backward from the back face of the putting surface;

a blocking surface comprising a projection provided above and extending generally vertically from the alignment surface along a center line between the toe end and the heel end of the head; and first and second alignment markers provided on the alignment surface extending toward the heel end and toe end, respectively, of the head such that at least a portion extending along an entire width of the alignment surface of at least one of the first and second marker is obscured by the blocking surface when viewed from an angle askew from vertical.

2. The putter of claim 1, wherein the first and second alignment markers are symmetrical to each other relative to the center line between the toe end and heel end of the head.

3. The putter of claim 1, wherein the blocking surface further comprises a second projection extending generally horizontally from the back face of the putting surface.

4. The putter of claim 3, wherein the second projection includes an aperture provided along the center line.

5. The putter of claim 1, wherein the alignment surface further comprises a third alignment marker provided along the center line and between the first and second reference markers.

6. The putter of claim 1, wherein the first and second alignment markers are provided on the alignment surface adjacent the projection.

7. The putter of claim 1, wherein the projection comprises stepped surfaces at different vertical heights from the top face of the alignment surface.

8. The putter of claim 1, wherein the blocking surface further comprises a recess in a top face of the blocking surface.

9. A putter comprising:

a shaft; and a head attached to a distal end of the shaft, wherein the head comprises:

a toe end furthest from the shaft;

a heel end nearest to the shaft;

a generally vertical putting surface having a front face and a back face;

a generally planar alignment surface extending backward from the back face of the putting surface, a blocking surface comprising first and second projections extending generally vertically from a top face of the alignment surface equal distances from a center line between the toe end and the heel end of the head; and alignment markers provided on a surface of each of the first and second projections nearest the center line such that at least a portion extending along an entire width of the alignment surface of at least one of the alignment markers is obscured by the blocking surface when viewed from an angle askew from vertical.

10. The putter of claim 9, wherein the projections have a sloped surface.

11. A putter comprising;

a shaft; and a head attached to a distal end of the shaft, wherein the head comprises:

a toe end furthest from the shaft;

a heel end nearest to the shaft;

a generally vertical putting surface having a front face and a back face;

a generally planar alignment surface extending backward from the back face of the putting surface, at least one blocking surface comprising a projection provided above and extending generally vertically from the alignment surface such that all of the at least one blocking surfaces are collectively symmetric to a center line between the toe end and the heel end of the head; and first and second alignment markers provided on the alignment surface to the heel end and toe end, respectively, of the head such that the first and second alignment markers are symmetrical to each other relative to the center line between the toe end and heel end of the head and wherein the first and second alignment markers do not appear symmetrical when viewed from an angle askew from vertical.

* * * * *